United States Patent [19]

Gretshel et al.

[11] Patent Number: 4,674,520

[45] Date of Patent: Jun. 23, 1987

[54] POWDER DRUM

[75] Inventors: James Gretshel, Brooklyn, N.Y.; Norman Chezek, Clifton, N.J.

[73] Assignee: Niemand Bros. Inc., Elmhurst, N.Y.

[21] Appl. No.: 785,000

[22] Filed: Oct. 7, 1985

[51] Int. Cl.[4] ..... A45D 33/00

[52] U.S. Cl. ..... 132/82 C; 132/82 R

[58] Field of Search ..... 132/83 C, 82 R, 82 A, 132/82 B, 82 C, 82 D, 82 E, 82 F, 82 G, 83 R, 83 B, 83 D, 83 F, 83 G, 83 H

[56] References Cited

U.S. PATENT DOCUMENTS

| | | | |
|---|---|---|---|
| 1,260,343 | 3/1918 | Decker | 132/82 G |
| 1,370,294 | 3/1921 | Dumons | 132/83 G |
| 2,082,614 | 6/1937 | Brodrick | 132/82 R |
| 2,365,908 | 12/1944 | Runnels | 132/82 R |
| 2,866,467 | 12/1958 | Bradford | 132/82 R |

*Primary Examiner*—John J. Wilson

*Attorney, Agent, or Firm*—Kane, Dalsimer, Kane, Sullivan and Kurucz

[57] ABSTRACT

A round or oval powder drum is disclosed which comprises a spirally wrapped paper construction body closed at both ends and sealed to prevent leakage of contained, dry fine powders.

1 Claim, 2 Drawing Figures

POWDER DRUM

BACKGROUND OF THE INVENTION

1. Field of the Invention

The invention relates to containers and more particularly relates to a drum type of container for the containment of powders such as talcum powder.

2. Brief Description of the Prior Art

Containers for powder materials required the highest degree of security to prevent the loss of contents. Any lack of integrity in seams, closures, etc. will result in failure of the container to affect its purpose. Generally, containers for powders have met the requirements for security by the use of costly materials and manufacturing methods. The container of the present invention is economical to manufacture, provides optimum security for contents, is lightweight to reduce shipping costs, is readily filled and optimizes space for shipping and handling.

SUMMARY OF THE INVENTION

The invention comprises a powder drum, which comprises;

(A) a spirally wrapped paper tube having a first open end, a second open end, and tube walls joining together the ends;

(B) a first closure for the first open end of the tube, said closure comprising a planar sheet of a frangible material, adapted by size and configuration to completely close the first end, said sheet including an annular peripheral margin comprising a downward projecting flange, said flange being wholly matingly sealed to the tube walls;

(C) a second closure for the second open end of the tube, said second closure being matingly sealed to the tube walls;

(D) said tube together with first and second closures defining an interior chamber for the containment of a dry powder;

(E) said second closure having an annular aperture therethrough providing access to the interior chamber, said aperture being defined by an interior edge of the second closure;

(F) a plug for the aperture, which comprises, an annular disc having upper and lower planar surfaces, said disc being adapted by size and configuration to overlie and close the aperture, said disc having on its upper surface an upward projecting skirt including means for securing the plug to the interior edge of the second closure; said plug being mounted in the aperture, thereby closing the aperture; and (G) seal means sealing the plug to the second closure.

The drum container of the invention is useful for the containment of dry powders.

DETAILED DESCRIPTION OF THE PREFERRED EMBODIMENTS OF THE INVENTION

Figure 1:
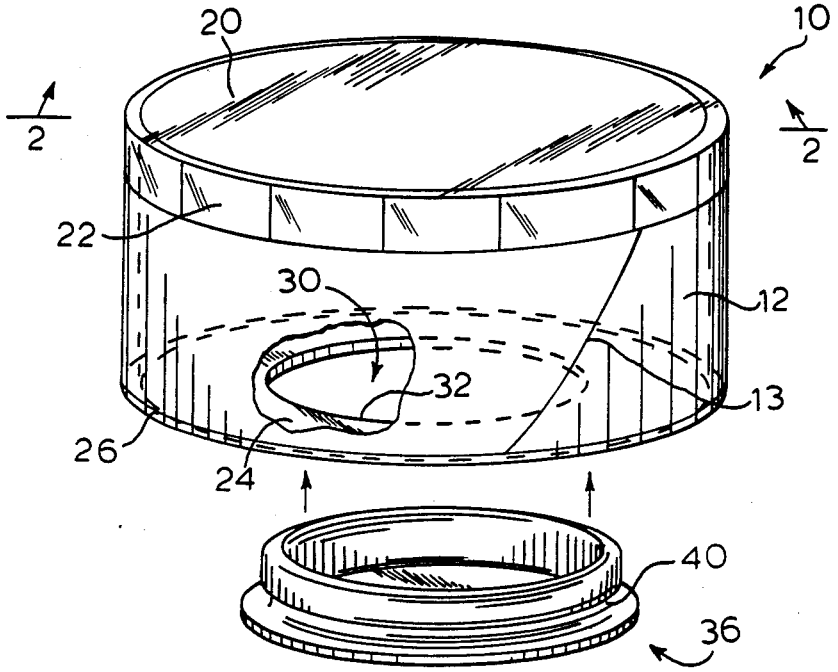
FIG. 1 is a view-in-perspective of an embodiment container of the invention, partially cut-away and partially disassembled.
Figure 2:
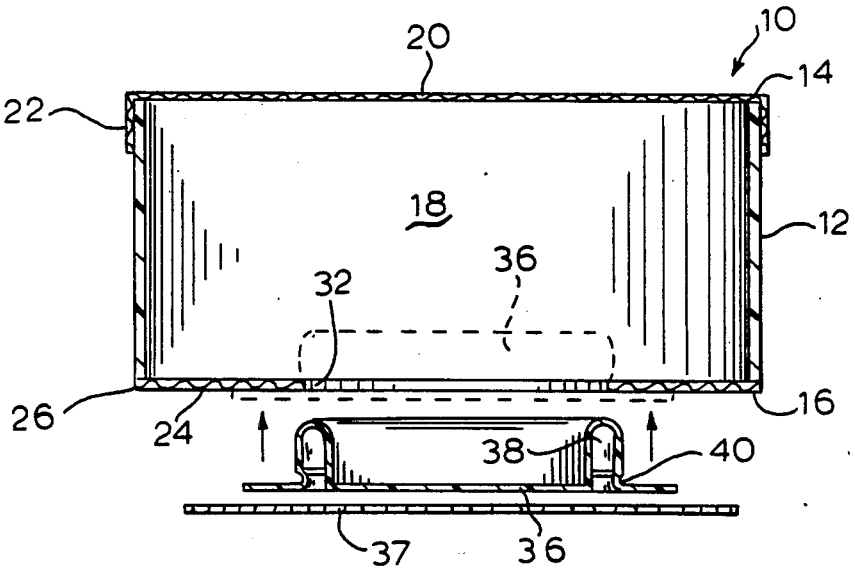
FIG. 2 is a view along lines 2—2 of FIG. 1, with an added seal component.

Those skilled in the art will gain an appreciation of the invention from a reading of the following description of the preferred embodiments of the invention, when read in conjunction with the accompanying drawings of FIGS. 1 and 2.

FIG. 1 is a view in perspective of an embodiment container 10 of the invention, partially cut away and partially disassembled for convenience in understanding.

The container 10 is a drum type of container especially adapted for the containment of dry powders. The container 10 comprises a spirally wrapped paper tube 12 having a first open end 14 and a second open end 16. The tube 12 comprises a wall joining together the ends 14, 16. A spirally wrapped paper tube 12 is particularly advantageous for the containment of dry powders since the seams are powder proof and assure containment of powders without their release through seams. The spirally wrapped tube may be manufactured by conventional means well-known in the art, in continuous lengths. The continuous lengths may be severed at any desired point to provide powder drums 10 of any desired height or shape. In general, for cosmetic powders the preferred drums 10 of the invention will have a diameter within the range of from 3 to 5 inches and a height of from about $\frac{3}{4}$ inch to 2 inches. The spirally wrapped construction of tube 12 is also advantageous in that it provides optimum strength as a wall of the container 10, either round or ovalized.

Closing the end 14 of the container 10 is a drum-tight sheet 20 of a frangible material adapted by size and configuration to completely close the first end 14. The sheet 20 includes an annular peripheral margin comprising a downward projecting flange 22. The flange 22 is integral with and part of the sheet 20 and is in its entirety, matingly sealed to the tube walls of tube 12 so that powders contained in the chamber 18 of the container 10 cannot escape through the joint of flange 22 with tube 12. The sheet 20 is preferably of a frangible material such as lightweight paper so that access to the chamber 18 of the container 10 may be had by breaking the drum-like sheet 20 with, for example, a fingernail.

A second closure for the second open end 16 of tube 12 may be of a heavier construction paperboard material than sheet 20. In the preferred embodiment container 10, the enclosure for end 16 is a paperboard, planar sheet 24 adapted by size and configuration to close the end 16 and to matingly seal with tube 12 about its periphery through an extension or flange 26. The seal between flange 26 and tube 12 may be effected with a suitable adhesive material, as is the case for establishing a seal between flange 22 and tube 12. Again, the seal between flange 26 and tube 12 is of such a nature that dry, fine powders contained in the chamber 18 cannot escape through the seals.

The tube 12 together with first and second closures 20, 24 define the interior chamber 18 for the containment of dry, fine powder.

The second closure 24 has a centrally located annular aperture 30 providing access to the interior chamber 18. The aperture 30 is defined by an interior edge 32 of the closure 24. A plug 36, preferably made of a synthetic polymeric resin material such as polystyrene or polypropylene functions to close the aperture 30. The plug 36 comprises an annular, planar disc having upper and lower planar surfaces. The plug 36 is adapted by size and configuration to overlie and close the aperture 30. The plug 36 bears on its upper surface an upward projecting skirt 38 including an annular groove 40 at its base which functions for securing the plug 36 within aperture 30 by an interference, biased fit with the edges 32 of the end closure 24. When inserted into the aperture 30, plug 36 makes a powder-proof seal between groove 40 and edge 32. The groove 40 also functions to hold plug 36 within aperture 30 so tightly that it cannot be removed without destruction of the edge 32. Preferably, the polymeric synthetic resin material making up plug 36 is of a slightly elastic nature so that it may be inserted into the aperture 30 readily but is difficult to remove because of the interrelationship between edge 32 and groove 40 of the plug 36.

In use, the container 10 may be filled with dry, fine powders through the aperture 30 and then plug 36 mounted in the aperture 30 to thereby permanently close aperture or by using material to glue over aperture 30.

FIG. 2 is a view along lines 2—2 of FIG. 1 and shows further details of the construction of the container 10. In addition, the FIG. 2 shows an added seal component in paper seal 37. Paper seal 37 may contain on one surface a pressure sensitive adhesive which may be affixed over the plug 36 after its insertion into aperture 30. This functions as an additional seal to assure containment of the fine, dry powders introduced through aperture 30 into the chamber 18. The sealing component 37 may also function as a label to receive indicia, for example indicating contents of the container 10. The sealing component 37 may be used without the plug 36 to seal.

In use, the container 10 may be employed to store and ship dry powders, such as talcum powders, cosmetic preparations and the like. When access to the contents of the container 10 are required, the frangible sheet 20 may be punctured to gain access to the contents of the chamber 18. The advantages of the container 10 include lower costs in manufacture, material, shipping and lower requirements for space storage.

What is claimed:

1. A powder drum which comprises:

(A) a spirally wrapped paper tube having a first open end, a second open end, and tube walls joining together the ends;

(B) a first closure for the first open end of the tube, said closure comprising a planar sheet of a frangible material, adapted by size and configuration to completely close the first end, said sheet including an annular peripheral margin comprising a downward projecting flange, said flange being wholly matingly sealed to the tube walls;

(C) a second closure for the second open end of the tube, said second closure being matingly and adhesively sealed to the tube walls;

(D) said tube together with first and second closures defining an interior chamber for the containment of a dry powder;

(E) said second closure having an annular aperture centrally located therethrough providing access to the interior chamber, said aperture being defined by an interior edge of the second closure;

(F) a plug for the aperture, which comprises, an annular disc having upper and lower planar surfaces, said disc being adapted by size and configuration to overlie and close the aperture, said disc having on its upper surface an upward projecting skirt including an annular groove positioned at the base of said skirt, said groove functioning for permanently securing the plug to the interior edge of the second closure by an interference, biased fit receiving the interior edge within the groove in a powder-proof seal; said plug being mounted in the aperture, thereby permanently sealing closed the aperture; and (G) a paper seal overlying the plug mounted in the aperture and adhesively secured to the plug and the second closure as an additional seal means sealing the aperture.

* * * * *